US006112850A

United States Patent [19]

Secrest et al.

[11] Patent Number: 6,112,850

[45] Date of Patent: Sep. 5, 2000

[54] ACOUSTIC SILENCER NOZZLE

[75] Inventors: Lynn Thomas Secrest, Holland; Paul Antony Tetley, Newtown, both of Pa.

[73] Assignee: Met Pro Corporation, Harleysville, Pa.

[21] Appl. No.: 09/390,796

[22] Filed: Sep. 7, 1999

[51] Int. Cl.[7] ..... E04F 17/04

[52] U.S. Cl. ..... 181/224; 181/225; 454/906

[58] Field of Search ..... 181/224, 225, 181/229, 217, 218, 222; 454/906, 346

[56] References Cited

U.S. PATENT DOCUMENTS

| | | | |
|---|---|---|---|
| 3,215,172 | 11/1965 | Ardoin . | |
| 3,511,336 | 5/1970 | Rink et al. . | |
| 3,540,547 | 11/1970 | Coward, Jr. | 181/224 |
| 3,572,464 | 3/1971 | Macdonald . | |
| 3,575,260 | 4/1971 | Urguhart et al. . | |
| 3,591,085 | 7/1971 | Medawar et al. . | |
| 3,605,939 | 9/1971 | Duthion . | |
| 3,611,726 | 10/1971 | Medawar . | |
| 3,613,826 | 10/1971 | Cabassut . | |
| 3,647,021 | 3/1972 | Millman et al. . | |
| 3,710,890 | 1/1973 | True et al. . | |
| 3,752,260 | 8/1973 | Heath . | |
| 3,949,830 | 4/1976 | Muehlbauer et al. . | |
| 3,982,605 | 9/1976 | Sneckenberger . | |
| 4,378,859 | 4/1983 | Satomi et al. . | |
| 4,418,788 | 12/1983 | Gorchev et al. . | |
| 4,422,524 | 12/1983 | Osborn . | |
| 4,433,751 | 2/1984 | Bonneau . | |
| 4,516,657 | 5/1985 | Allard . | |
| 4,806,076 | 2/1989 | Andrews . | |
| 5,117,939 | 6/1992 | Noguchi et al. . | |
| 5,291,672 | 3/1994 | Brown . | |
| 5,326,317 | 7/1994 | Ishizu et al. | 454/906 |
| 5,439,349 | 8/1995 | Kupferberg . | |
| 5,513,266 | 4/1996 | Zuroski . | |
| 5,696,361 | 12/1997 | Chen . | |
| 5,717,172 | 2/1998 | Griffin, Jr. et al. . | |

*Primary Examiner*—Khanh Dang
*Attorney, Agent, or Firm*—Woodcock Washburn Kurtz Mackiewicz & Norris LLP

[57] ABSTRACT

An acoustic silencer nozzle for ventilation and exhaust fans. The nozzle provides at least two converging exhaust paths, each of which extend through an area that is adjacent acoustically absorbing media or resonating chambers. In this manner, the noise is reduced at the nozzle or outlet portion and provides a tight plume of high velocity discharge flow. Preferably, the nozzle has at least one opening that allows for ambient atmospheric air to mix with the exhaust gases at the outlet of the nozzle.

23 Claims, 6 Drawing Sheets

ACOUSTIC SILENCER NOZZLE

FIELD OF THE INVENTION

The present invention relates in general to nozzles for ventilation fans, and more particularly, to high velocity silencer nozzles for use with exhaust fans.

BACKGROUND OF THE INVENTION

Prior art devices have been designed to provide a high velocity jet for exhausting atmosphere and other gases, as described in, for example, U.S. Pat. No. 4,806,076, issued to Andrews, and U.S. Pat. No. 5,439,349, issued to Kupferberg. These exhaust fans are typically mounted on the roof areas of buildings and are used to carry exhaust gases as high as possible above the roof line of the building so as to ensure an effective final dilution of the gases within the greatest possible volume of ambient air and their dispersal over a large area with maximum dilution. The fan in U.S. Pat. No. 4,806,076 has a nozzle in which two converging flow paths are defined by two respective passageways. The walls forming these passageways are shaped as sectors of conical sections. A wind band is provided at one end of the two passages at the outlets thereof to provide an entrainment of fresh air to mix with the gases exhausting from the two passageways.

Conventional exhaust fans for moving large volumes of air often generate high levels of noise which is undesirable. As a result, a wide variety of fan silencing equipment has been proposed to absorb fan noise, thereby reducing fan noise to an acceptable level. However, conventional silencers are used at the fan portion of the device, and do not control noise at the nozzle or outlet portion. These conventional silencers are undesirable for several reasons, including because they lead to an increase in the overall height of the fan device and they are limited to a relatively low air distribution velocity (on the order of less than about 3000 feet per minute) in which they are effective (i.e., provide maximum attenuation without themselves generating any significant additional noise). Therefore, a need exists for a device that controls noise at the nozzle or outlet portion to reduce the height of a fan or other device and provide a relatively high air distribution velocity, without adding significantly to system pressure.

SUMMARY OF THE INVENTION

The present invention is directed to an acoustic silencer nozzle for apparatus such as ventilation and exhaust fans. The nozzle provides at least two converging exhaust paths, each of which extend through an area that is adjacent to any acoustically absorbing media or resonating chambers. In this manner, the noise is reduced at the nozzle or outlet portion and provides a tight plume of high velocity flow. Preferably, the nozzle has at least one opening that allows for ambient atmospheric air to mix with the exhaust gases at the outlet of the nozzle.

According to one embodiment of the present invention, an acoustic silencer nozzle comprises: first and second outer wall sections each approximately shaped as a partial conical section being concave toward each other, or cylindrical or straight on the inner walls, and being oppositely positioned with respect to one another, at least a portion of each of the first and second outer wall sections comprising a perforated material, at least one first upper air outlet and at least one second upper air outlet for releasing exhaust gases therefrom; a first outer sheath disposed adjacent the portion of the first outer wall section comprising the perforated material to define a first outer enclosed space; a second outer sheath disposed adjacent the portion of the second outer wall section comprising the perforated material to define a second outer enclosed space; a first inner wall section positioned in spaced relation with respect to the first outer wall section, the first inner wall section being approximately shaped as a partial conical, cylindrical, or straight section being convex or straight toward the first outer wall section to define at least one first exhaust flow path therebetween adapted to receive exhaust gases and guide same to release upwardly through the first upper air outlet; a first inner sheath disposed adjacent the portion of the first inner wall section comprising the perforated material to define a first inner enclosed space; a second inner wall section positioned in spaced relation with respect to the second outer wall section, at least a portion of each of the first and second inner wall sections comprising a perforated material, the second inner wall section being approximately shaped as a partial conical, cylindrical, or straight section being convex or straight toward the second inner wall section to define at least one second exhaust flow path therebetween adapted to receive exhaust gases and guide same to release upwardly through the second upper air outlet, the first and second exhaust flow paths converging; a second inner sheath disposed adjacent the portion of the second inner wall section comprising the perforated material (or other similar material such as expanded metal or foam) to define a second inner enclosed space; acoustically absorbing media disposed in the first and second outer enclosed spaces and the first and second inner enclosed spaces; at least one first end wall extending from the first inner wall section to the first outer wall section to confine gases passing therebetween within the first exhaust flow path, the first exhaust flow path passing the first outer enclosed space and the first inner enclosed space; at least one second end wall extending from the second inner wall section to the second outer wall section to confine gases passing therebetween within the second exhaust flow path, the second exhaust flow path passing the second outer enclosed space and the second inner enclosed space to absorb noise through the sections comprising the perforated material (or other similar material such as expanded metal or foam) into the acoustically absorbing media.

BRIEF DESCRIPTION OF THE DRAWINGS

The foregoing and other aspects of the present invention will become apparent from the following detailed description of the invention when considered in conjunction with the accompanying drawings. For the purpose of illustrating the invention, there is shown in the drawings an embodiment that is presently preferred, it being understood, however, that the invention is not limited to the specific methods and instrumentalities disclosed. In the drawings.

DESCRIPTION OF EXEMPLARY EMBODIMENTS AND BEST MODE

The present invention provides an acoustic silencer nozzle for use with apparatus such as ventilation and exhaust fans. The nozzle provides at least two converging exhaust paths, each of which extend through an area that is adjacent acoustically absorbing media or resonating chambers. In this manner, the noise is reduced at the nozzle or outlet portion and provides a tight plume of high velocity flow. Preferably, the nozzle has at least one opening that allows for ambient atmospheric air to mix with the exhaust gases at the outlet of the nozzle.

Figure 1:
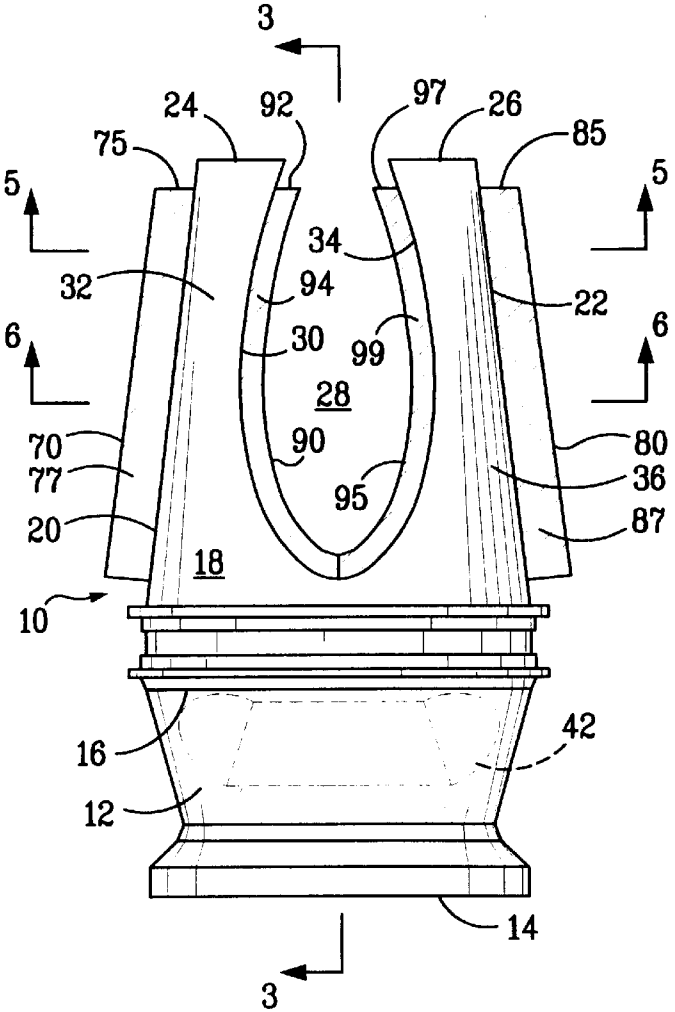
FIG. 1 is a front plan view of an exemplary acoustic silencer nozzle in accordance with the present invention incorporated into an exhaust fan.

A first exemplary embodiment in accordance with the present invention is shown in FIG. 1. An exhaust fan apparatus, such as a radial upblast, mixed flow, centrifugal, or axial exhaust fan, includes a main housing 10 having a fan housing 12 in the lower section thereof and acoustic silencer nozzle 18 positioned above the fan housing 12 and extending upwardly therefrom. The fan housing 12 defines a fan inlet 14 adapted to receive gases for exhausting thereabove and a fan outlet 16 for allowing movement of the gases upwardly from the fan housing 12 into the acoustic silencer nozzle 18.

The acoustic silencer nozzle 18 defines a first outer wall section 20 and a second outer wall section 22 being generally conical sections and being concave, cylindrical, or straight with respect to one another. The acoustic silencer nozzle 18 further defines a first upper air outlet 24 and a second upper air outlet 26 at the uppermost portion thereof. A passive zone section 28 defining a passive zone chamber 48 is located between the first outer wall section 20 and the first upper air outlet 24 and the second outer wall section 22 and the second upper air outlet 26. The passive zone supplies air for mixing by induction into the contaminated air being exhausted through the two upper outlets.

The passive zone section 28 defines a first inner wall section 30 which is shaped as a conical, cylindrical, or straight section being convex or straight facing outwardly toward the first outer wall section 20. A first exhaust flow path 32 is defined between the first inner wall section 30 and the first outer wall section 20. In a similar manner, the passive zone section 28 defines a second inner wall section 34 which is shaped as a conical section and is convex facing outwardly and in spaced relation with respect to the second outer wall section 22 to define a second exhaust flow path 36 therebetween.

At least a portion of the first outer wall 20 and the first inner wall 30 comprise a perforated material, such as perforated steel, fiberglass, or polypropylene. Similarly, at least a portion of the second outer wall 22 and the second inner wall 34 comprise the perforated material.

First and second outer sheaths 70, 80 are disposed adjacent the section of the outer walls 20, 22 comprising the perforated material. The outer sheaths 70, 80 and the perforated sections have respective partitions spaced therebetween thus providing respective outer enclosed spaces or chambers 75, 85. The outer enclosed spaces 75, 85 have disposed therein an acoustic absorbing material 77, 87, such as stainless steel wool or a fiberglass material or any acoustically treated media. Alternatively, the outer enclosed spaces 75, 85 can each be a resonating chamber. The outer enclosed spaces or chambers 75, 85 are closed at either end. As the air travels down the exhaust flow paths 32, 36, noise is absorbed through the perforations in the surfaces of the outer walls 20, 22 into the acoustical fill material 77, 87.

Similarly, inner sheaths 90, 95 are disposed adjacent the perforated sections on the inner walls 30, 34, respectively. The inner sheaths 90, 95 and the perforated sections have respective partitions spaced therebetween thus providing respective inner enclosed spaces or chambers 92, 97. The inner enclosed spaces 92, 97 have disposed therein an acoustic absorbing material 94, 99, such as plastic, coated or galvanized steel, stainless steel, mineral wool, or a fiberglass material or any acoustically treated media, and may also include a chemical resistant wrap or barrier such as mylar, polyurethane, or similar material to prevent exhaust pollutants, moisture, or mold from accumulating in the acoustical material or cavity. Alternatively, the inner enclosed spaces 92, 97 can each be a resonating chamber. The inner enclosed spaces or chambers 92, 97 are closed at either end. As the air travels down the exhaust flow paths 32, 36, noise is absorbed through the perforations in the surfaces of the inner walls 30, 34 into the acoustical fill material 94, 99.

Preferably, the holes in the perforated section constitute about 20 to 75 percent of the area thereof and are approximately 3/32, to 1 inch in diameter, and the perforated section covers at least about 50 to 100 percent of the length of the outer and inner walls.

Figure 5:
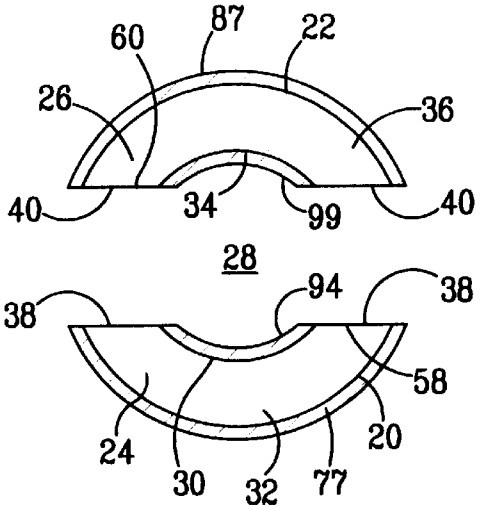
FIG. 5 is a cross sectional view of an exemplary acoustic silencer nozzle of the present invention as shown in FIG. 1 along lines 5—5.
Figure 6:
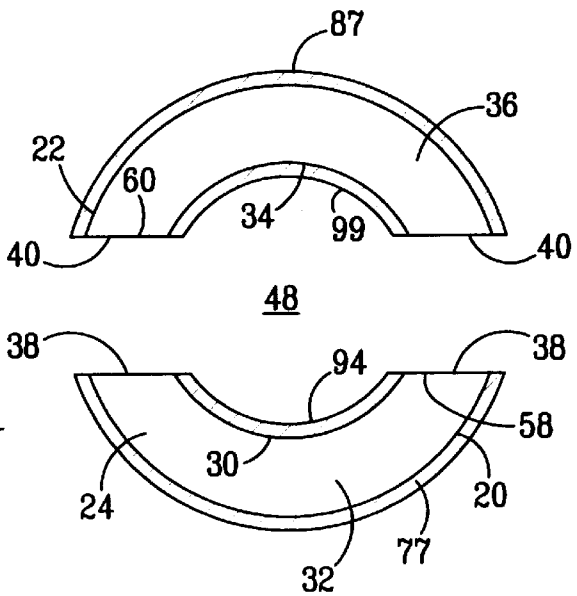
FIG. 6 is a cross sectional view of an exemplary acoustic silencer nozzle of the present invention as shown in FIG. 1 along lines 6—6.

A first end wall 38 which may take the form of two end walls 58 may be positioned extending between the first inner wall section 30 and the first outer wall section 20. These end walls as shown in FIGS. 5 and 6 aid in the definition of the first exhaust flow path 32. In a similar manner, the second end wall 40 which may take the form of two second end walls 60 can be positioned extending from the second inner wall section 34 to the second outer wall section 22 to facilitate defining the second exhaust flow path 36.

Figure 7:
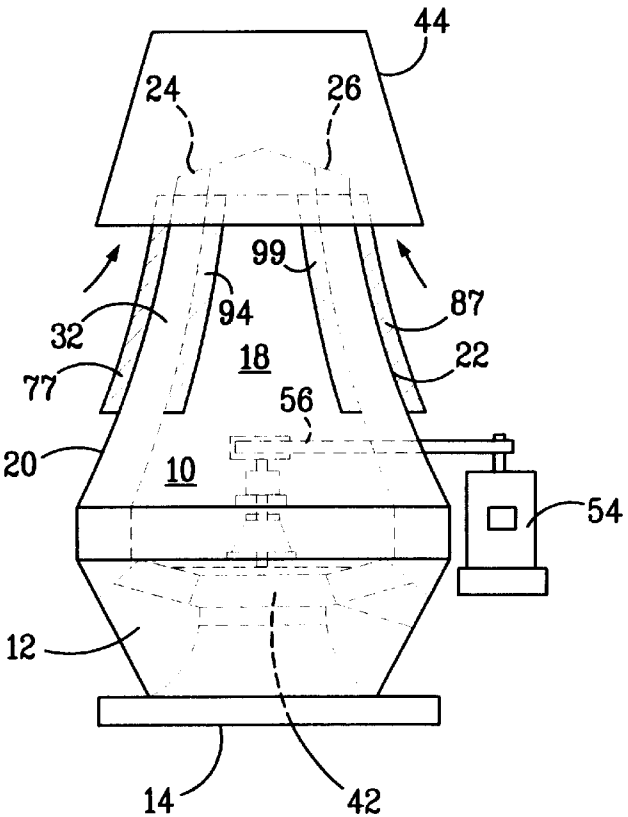
FIG. 7 is a front plan view of an alternative embodiment of the acoustic silencer nozzle of the present invention showing a remotely positioned embodiment of a fan drive.

To facilitate the flow of air to be exhausted through the first and second exhaust flow paths, a fan 42 may preferably be positioned within the fan housing 12. A fan is operatively connected with respect to a fan drive 54 to control operation thereof. The fan drive 54 may be positioned within the passive zone chamber 48 or may be positioned externally from the main housing 10 of the present invention as shown in FIG. 7 or entirely below the nozzle section. In the configuration shown in FIG. 7, a belt drive 56 may be included positioned within the passive zone section 28 and may be operatively secured with respect to the drive 54 which itself may be secured with respect to the outer portion of the main housing 10.

To facilitate mixing of the exhausted gas with the ambient environmental gases, a wind band 44 may be positioned vertically extending in general parallel relationship with respect to the upper end of the acoustic silencer nozzle 18.

Figure 4:
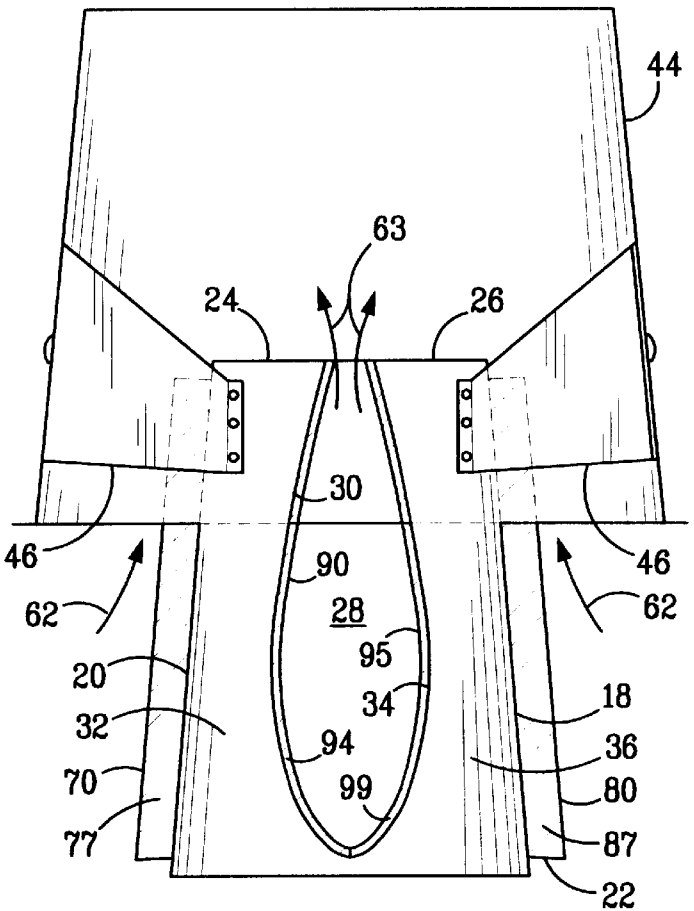
FIG. 4 is a front plan view of exemplary acoustic silencer nozzle in accordance with the present invention showing the usage of a wind band positioned therearound.

Preferably, the wind band 44 is located in spaced relation with respect to the outer walls of the acoustic silencer nozzle 18 by a wind band bracket 46. In this manner, when gases are exhausted through the first upper air outlet 24 and the second upper air outlet 26, air will be induced to flow as shown in FIG. 4 by arrows 62. Air will also be induced to flow from the passive zone chamber 48 upwardly as shown by arrow 63 into the contaminated gases being exhausted through the two upper outlets to facilitate mixing therewith. Preferably, ambient air mixes with the exhausting air immediately upon movement of the exhausting gases outwardly through the upper outlets 24 and 26. The wind band 44 will protect the vena contracta produced by the converging flow (plume) from the primary exhaust passageway.

Figure 2:
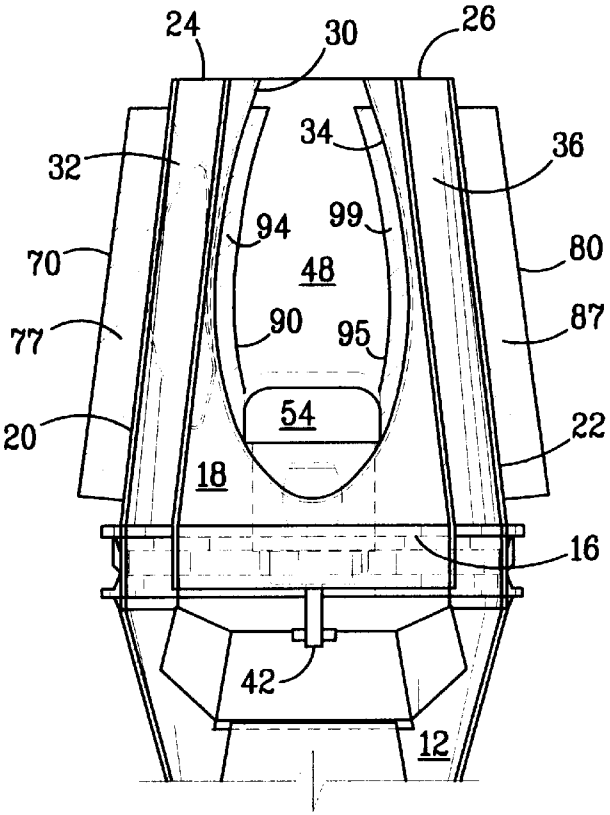
FIG. 2 is a front cross sectional view of the silencer nozzle of FIG. 1.
Figure 3:
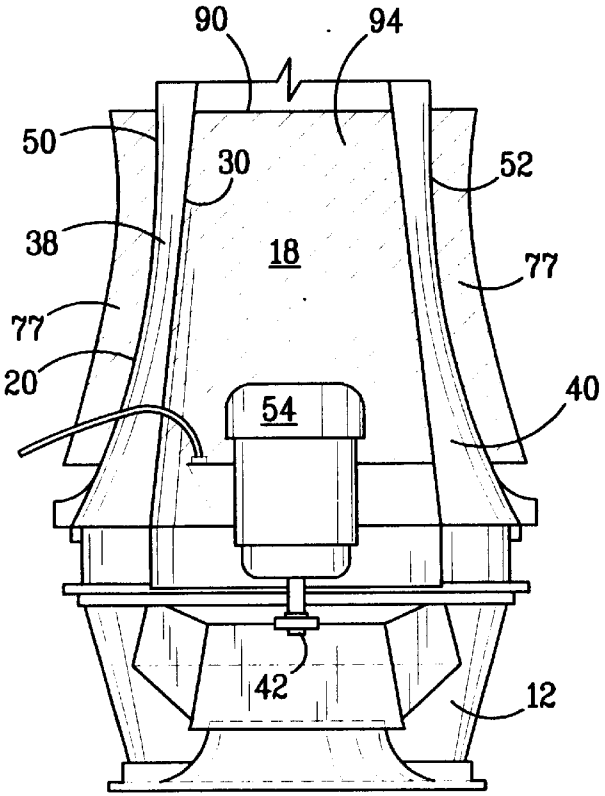
FIG. 3 is a side cross sectional view of the silencer nozzle of FIG. 1 as taken along lines 3—3 in FIG. 1.

The cross section shown in FIG. 3 is perpendicular through a horizontally extending plane with respect to the cross section shown in FIG. 2. As such, the shape of the first exhaust flow path 32 and the second exhaust flow path 36 in FIG. 2 is shown to be parallel and vertically extending inclined inwardly toward the passive zone. In FIG. 3, the view is along lines 3—3 in FIG. 1 and as such the external surface of the first and second end walls 38 and 40 are shown therein. These walls show a configuration with a first intermediate point 50 positioned in the outer wall of first end wall 38 and a second intermediate point 52 positioned in the outer wall of second end wall 40. Thus we see that the cross section through the exhaust flow paths are as shown in FIG. 2 when taken through the central portion thereof and tend to assume the shape of the outer surface of the first and second end walls 38 and 40 shown in FIG. 3 toward the outer peripheral edges of the first and second exhaust flow paths 32 and 36. The usage of the conical sections for the walls defining the exhaust flow paths is important in view of the high volume of air flow which is encountered by such upblast exhausting systems.

The exemplary apparatus of the present invention can include two or more vertical flow paths and thus two or more upper contaminated air outlets. The present invention defines basically one on one side and one on another with a passive zone therebetween. Each of these can be divided into multiple sections such that any number of individual upper flow paths can be defined positioned circumferentially about the passive zone.

During operation of the silencer of the present invention, a primary stream of fluid (e.g., exhaust) moves at a velocity of at least about 2000 ft/min (with respect to the ambient fluid in the atmosphere), and preferably up to about 6600 ft/min. The movement of the primary stream of fluid sets up aspiration in such a manner so that a secondary stream of fluid is drawn from the ambient fluid of the atmosphere.

It should be noted that the exhaust paths 32, 36 converge in order to keep the exhaust plume tight, which can create a current of air on the order of about 110 feet in diameter moving at about 250 ft/min in still air. This helps to dilute effluent or fumes prior to release into the atmosphere, thus effectively minimizing pollution problems with extremely high efficiency.

Figure 8:
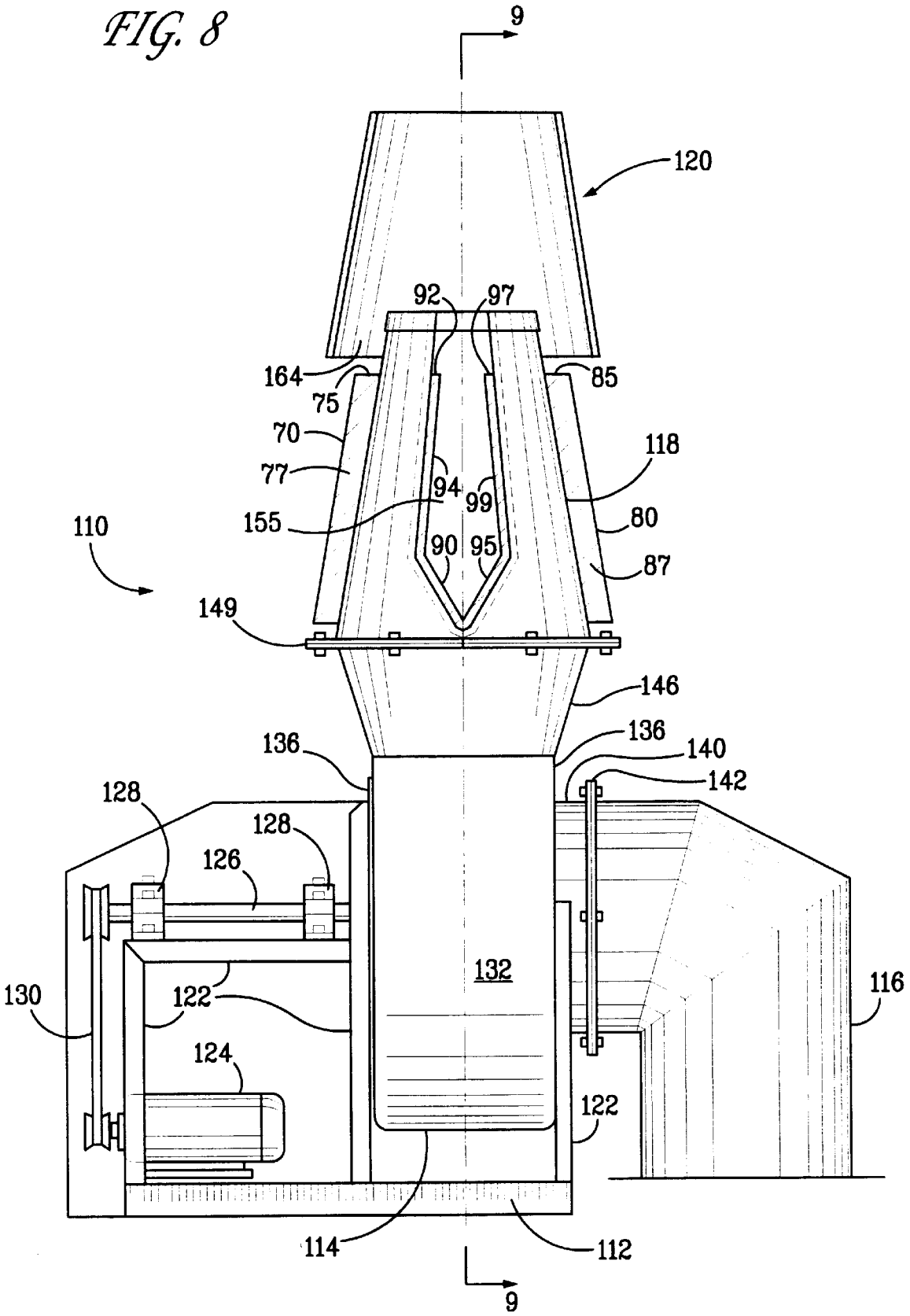
FIG. 8 is a front elevation of an exemplary acoustic silencer nozzle incorporated into another exhaust fan in accordance with the present invention.

Another exemplary exhaust fan comprising an acoustic silencer nozzle in accordance with the present invention is described with respect to FIG. 8. The apparatus 110 has a base 112 meant to be mounted on a roof, a centrifugal fan casing 114 mounted on the base 112, and an inlet duct 116 extending to one side of the casing 114 from the interior of a building (not shown). Mounted to the top of the centrifugal fan casing 114 is an exhaust stack or nozzle 118, and topping the exhaust stack is a ring 120 of frusto-conical shape.

Similar to the above embodiments, a portion of the inner and outer walls of the stack or nozzle 118 comprise a perforated material, such as perforated steel, fiberglass, or polypropylene. First and second outer sheaths 70, 80 are disposed adjacent the section of the outer walls comprising the perforated material. The outer sheaths 70, 80 and the perforated sections have respective partitions spaced therebetween thus providing respective outer enclosed spaces or chambers 75, 85. The outer enclosed spaces 75, 85 have disposed therein an acoustic absorbing material 77, 87, such as plastic, coated or galvanized steel, stainless steel, mineral wool, or a fiberglass material or any acoustically treated media, and may also include a chemical resistant wrap or barrier such as mylar, polyurethane, or similar material to prevent exhaust pollutants, moisture, or mold from accumulating in the acoustical material or cavity. Alternatively, the outer enclosed spaces 75, 85 can each be a resonating chamber. The outer enclosed spaces or chambers 75, 85 are closed at either end. As the air travels down the exhaust flow paths, noise is absorbed through the perforations in the surfaces of the outer walls into the acoustical fill material 77, 87.

Similarly, inner sheaths 90, 95 are disposed adjacent the perforated sections on the inner walls. The inner sheaths 90, 95 and the perforated sections have respective partitions spaced therebetween thus providing respective inner enclosed spaces or chambers 92,97. The inner enclosed spaces 92,97 have disposed therein an acoustic absorbing material 94, 99, such as plastic, coated or galvanized steel, stainless steel, mineral wool, or a fiberglass material or any acoustically treated media, and may also include a chemical resistant wrap or barrier such as mylar, polyurethane, or similar material to prevent exhaust pollutants, moisture, or mold from accumulating in the acoustical material or cavity. Alternatively, the inner enclosed spaces 92, 97 can each be a resonating chamber. The inner enclosed spaces or chambers 92, 97 are closed at either end. As the air travels down the exhaust flow paths, noise is absorbed through the perforations in the surfaces of the inner walls into the acoustical fill material 94, 99.

Figure 9:
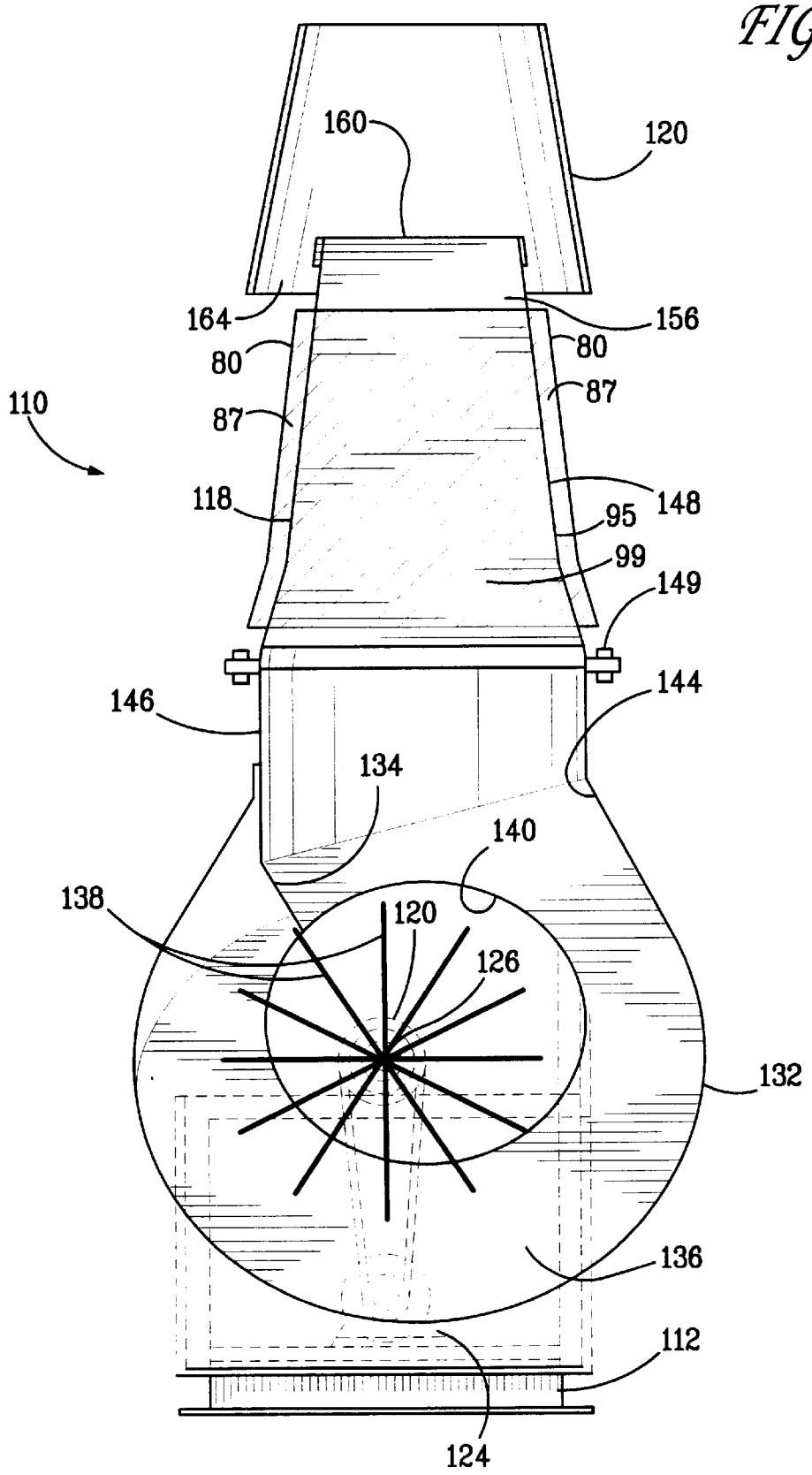
FIG. 9 is a vertical cross section taken along line 9—9 of FIG. 8.

The base 112 includes a frame 122 on which a motor 124 is mounted. A shaft 126 is journaled in bearing brackets 128 mounted on the frame 122 and extends within the casing 132 in a cantilevered manner. The shaft 126 is driven by a drive belt 130 taken off the motor 124. As shown in FIG. 9, shaft 126 mounts a centrifugal impeller 138 having multiple vanes rotating about the axis of the shaft 126.

The casing 114 includes a scroll 132 surrounding the impeller 138 and interrupted by discharge port 144. The scroll 132 includes a cut-off 134 near the discharge port 144. The casing 114 also includes parallel side walls 136. An inlet port 140 is defined on one side wall 136 of the casing 114, and connector flanges 142 are provided to fasten the inlet port 140 with the inlet duct 116.

Thus, the spent gases containing airborne contaminants exhausting from the building through the duct 116 enter the casing 114 axially relative to the impeller 138, and the air flow is accelerated through the discharge port 144. A diffuser tube 146 is mounted to and communicates with the discharge port 144. The diffuser tube 146 is in turn connected to the bifurcated duct 148 by means of connecting flanges 149. The bifurcated duct 148 includes passageways 150 and 152 which are generally parallel although they, in fact, converge slightly towards the outlet. A central opening 155 is formed by means of inner flat walls 154 and 156 defining the passageways 150 and 152 respectively.

Figure 10:
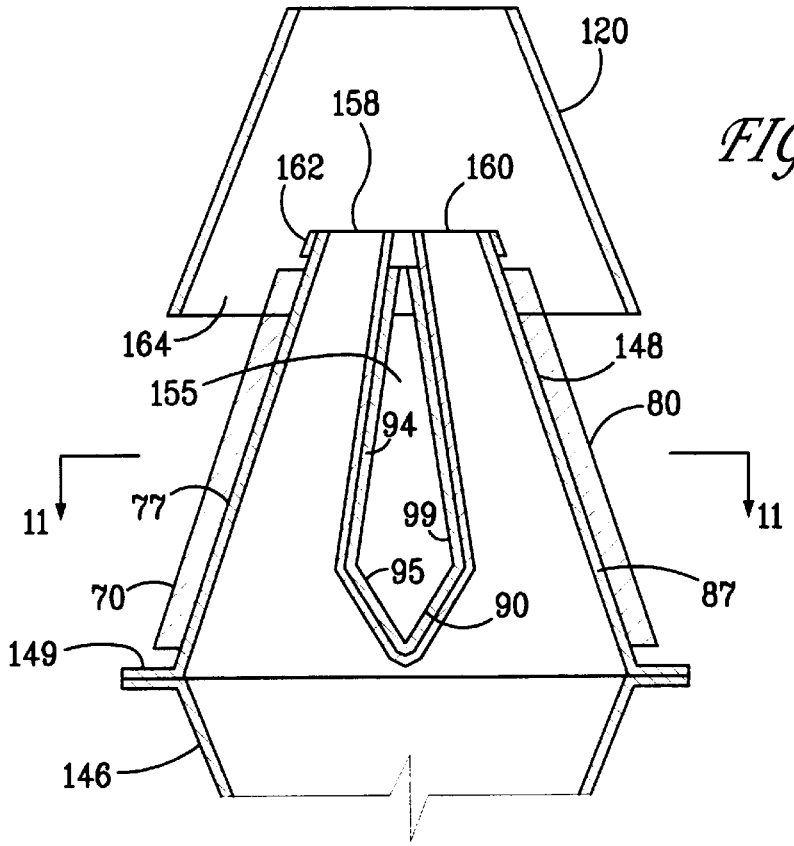
FIG. 10 is a fragmentary vertical cross section of a detail of the embodiment shown in FIG. 8.
Figure 11:
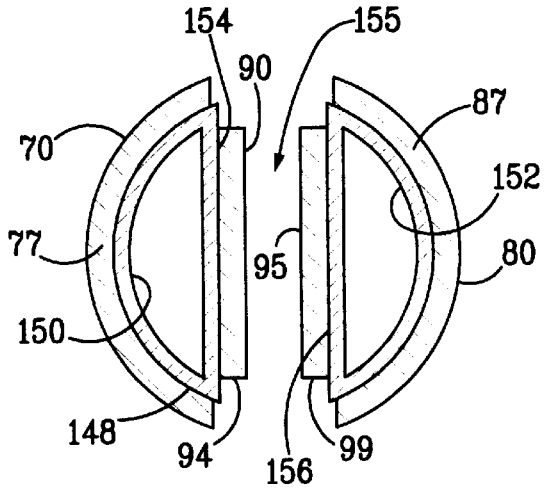
FIG. 11 is a horizontal cross section taken along line 11—11 of FIG. 10.

As shown in FIGS. 10 and 11, outlet ports 158 and 160 are defined at the upper end of the bifurcated duct 148, communicating with passageways 150 and 152 respectively. An annular ring 162 extends about the upper end of the bifurcated duct 148. An annulus 164 is formed between the ring 120 and the ring 162.

In operation, the impeller 138, driven by motor 124, will draw the exhaust gases from the building containing airborne contaminants through the duct 116 and then upwardly into the stack or nozzle 118 by first passing through the diffuser and then the double passageways 150 and 152. The location of the casing 114 and, in particular, the orientation of the scroll 132 relative to the stack or nozzle 118, permits even distribution of the air flow into the diffuser and through the passageways 150 and 152. The spent gases exhaust through the outlet ports 158 and 160 at relatively high velocity and cause ambient air to be induced into the annulus 164 to mix with the airborne contaminants and, therefore, dilute the exhaust.

The present invention provides the advantages of lower stack height and increased safety. The present invention minimizes the static pressure loss in the system, and increases attenuation over a typical silencer at the higher velocity. The present invention also provides greater accessibility to interior parts (e.g., a motor) for inspection.

It is contemplated that the nozzle silencer of the present invention can be used with any type of outlet. The fan, motor, and drive can be located anywhere. The present invention can be used with fans of various types or other such apparatus that emit an exhaust at a velocity of over about 2000 ft/min.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed:

1.An acoustic silencer nozzle comprising:

a first outer wall section and a second outer wall section each approximately shaped as a partial conical section being concave toward each other and being oppositely positioned with respect to one another, at least a portion of each of the first and second outer wall sections comprising a perforated material, at least one first upper air outlet and at least one second upper air outlet for releasing exhaust gases therefrom;

a first outer sheath disposed adjacent the portion of the first outer wall section comprising the perforated material to define a first outer enclosed space;

a second outer sheath disposed adjacent the portion of the second outer wall section comprising the perforated material to define a second outer enclosed space;

a first inner wall section positioned in spaced relation with respect to said first outer wall section, said first inner wall section being approximately shaped as one of a partial conical, cylindrical, and straight section being convex or straight toward said first outer wall section to define at least one first exhaust flow path therebetween adapted to receive exhaust gases and guide same to release upwardly through said first upper air outlet;

a first inner sheath disposed adjacent the portion of the first inner wall section comprising the perforated material to define a first inner enclosed space;

a second inner wall section positioned in spaced relation with respect to said second outer wall section, at least a portion of each of the first and second inner wall sections comprising a perforated material, said second inner wall section being approximately shaped as a one of a partial conical, cylindrical, and straight section being convex or straight toward said second inner wall section to define at least one second exhaust flow path therebetween adapted to receive exhaust gases and guide same to release upwardly through said second upper air outlet, the first and second exhaust flow paths converging;

a second inner sheath disposed adjacent the portion of the second inner wall section comprising the perforated material to define a second inner enclosed space;

acoustically absorbing media disposed in the first and second outer enclosed spaces and the first and second inner enclosed spaces;

at least one first end wall extending from said first inner wall section to said first outer wall section to confine gases passing therebetween within said first exhaust flow path, said first exhaust flow path passing the first outer enclosed space and the first inner enclosed space to absorb noise through the sections comprising the perforated material into the acoustically absorbing media; and at least one second end wall extending from said second inner wall section to said second outer wall section to confine gases passing therebetween within said second exhaust flow path, said second exhaust flow path passing the second outer enclosed space and the second inner enclosed space to absorb noise through the sections comprising the perforated material into the acoustically absorbing media.

2. The nozzle according to claim 1, wherein the perforated material comprises one of steel, fiberglass, and polypropylene.

3. The nozzle according to claim 1, wherein the acoustic absorbing media comprises one of plastic, coated or galvanized steel, stainless steel, mineral wool, and a fiberglass material.

4. The nozzle according to claim 1, wherein the acoustic absorbing media further comprises a chemical resistant wrap or barrier.

5. The nozzle according to claim 1, wherein the acoustic absorbing media comprises at least one resonating chamber.

6. The nozzle according to claim 1, wherein the holes in the perforated section constitute about 20 to 75 percent of the area thereof.

7. The nozzle according to claim 1, wherein the perforated section covers at least about 50 to 100 percent of the length of the outer and inner walls.

8. The nozzle according to claim 1, wherein the flow of fluid through the first and second exhaust paths sets up aspiration in such a manner so that a further flow of fluid is drawn from ambient atmosphere.

9. An exhaust fan apparatus comprising:

(a) main housing comprising:

a fan housing defining a fan inlet to receive air to be exhausted and a fan outlet to expel air to be exhausted; and an acoustic silencer nozzle according to claim 1 positioned immediately above said fan housing, said acoustic silencer nozzle being in fluid flow communication with said fan housing through said fan outlet to receive exhaust gases therefrom for expelling, wherein said first exhaust flow path is adapted to receive exhaust gases from said fan outlet and guide same to release upwardly through said first upper air outlet;

wherein said second exhaust flow path is adapted to receive exhaust gases from said fan outlet and guide same to release upwardly through said second upper air outlet; and (b) a fan positioned within said fan housing and adapted to draw air for exhausting in through said fan inlet and expel air for exhausting out through said fan outlet into said first exhaust flow path and said second exhaust flow path.

10. An exhaust fan apparatus according to claim 9, including one first end wall and one second end wall and wherein said acoustic silencer nozzle defines one first upper air outlet and one second upper air outlet and wherein said first inner wall section and said first outer wall section define one first exhaust flow path therebetween and wherein said second inner wall section and said second outer wall section define one second exhaust flow path therebetween.

11. An exhaust fan apparatus according to claim 10, wherein said first inner wall section is inclined upwardly and inwardly toward said first outer wall section to taper said first exhaust flow path to a smaller lateral dimension in the upper area thereof, and wherein said second inner wall section is inclined upwardly and inwardly toward said second outer wall section to taper said second exhaust flow path to a smaller lateral dimension in the upper area thereof.

12. An exhaust fan apparatus according to claim 10, wherein said first outer wall section is inclined upwardly and inwardly toward said first inner wall section to taper said first exhaust flow path to a smaller lateral dimension in the upper area thereof, and wherein said second outer wall section is inclined upwardly and inwardly toward said second inner wall section to taper said second exhaust flow path to a smaller lateral dimension in the upper area thereof.

13. An exhaust fan apparatus according to claim 10, further including a wind band positioned circumferentially around said first upper air outlet and said second upper air outlet and the upper portion of said acoustic silencer nozzle, said wind band extending vertically and in spaced relation with respect to the upper end of said acoustic silencer nozzle to induce the flow of environmental gas from therebelow to mix with and dilute the gases being exhausted from said first upper air outlet and said second upper air outlet.

14. An exhaust fan apparatus according to claim 13, further comprising a wind band bracket secured with respect to said acoustic silencer nozzle and attached with respect to said wind band for retaining thereof in spaced relation to said acoustic silencer nozzle.

15. An exhaust fan apparatus according to claim 10, further comprising a passive zone chamber positioned between said first exhaust flow path and said second exhaust flow path.

16. An exhaust fan apparatus according to claim 10, wherein said first outer wall section and said first inner wall section are parallel with respect to one another vertically to define said first exhaust flow path of constant lateral dimension, said first outer wall section and said first inner wall section being inclined upwardly and inwardly, and wherein said second outer wall section and said second inner wall section are parallel with respect to one another vertically to define said second exhaust flow path of constant lateral dimension, said second outer wall section and said second inner wall section being inclined upwardly and inwardly.

17. An exhaust fan apparatus according to claim 10, wherein at least one of(1) said first inner wall section is linearly straight vertically and wherein said first outer wall section is vertically arcuate with respect thereto and (2) said second inner wall section is linearly straight vertically and wherein said second outer wall section is vertically arcuate with respect thereto.

18. An exhaust fan apparatus according to claim 10, further comprising at least one of a fan drive and a belt drive operatively connected to said fan within said fan housing to control operation thereof.

19. An exhaust fan apparatus comprising a housing having an upper portion and a lower portion, wherein the lower portion includes a centrifugal fan scroll casing, the scroll casing having parallel side walls, a shaft extending within the casing normal to the side wall and mounting an impeller for rotation therewithin, motor means for driving the shaft, an inlet port provided axially of the fan shaft axis on a side wall of the casing, a discharge port extending from the scroll, a first tubular diffuser portion communicating with the fan discharge port and a second tubular portion extending upwardly from the first tubular portion, the second tubular portion being bifurcated to provide at least two passageways having generally parallel axes generally normal to the axis of the fan shaft, and wherein the axes of the passageways lie in a plane which is parallel to the axis of the fan, each of the two passageways having an inner wall section and an outer wall section comprising a perforated material, a first outer sheath disposed adjacent the portion of the first outer wall section comprising the perforated material to define a first outer enclosed space, a second outer sheath disposed adjacent the portion of the second outer wall section comprising the perforated material to define a second outer enclosed space, a first inner sheath disposed adjacent the portion of the first inner wall section comprising the perforated material to define a first inner enclosed space, a second inner sheath disposed adjacent the portion of the second inner wall section comprising the perforated material to define a second inner enclosed space, acoustically absorbing media disposed in the first and second outer enclosed spaces and the first and second inner enclosed spaces, wherein noise is passed through the sections comprising the perforated material into the acoustically absorbing media.

20. An exhaust fan apparatus as defined in claim 19, wherein the second tubular portion includes a pair of spaced-apart outlet ports corresponding to the two passageways, and a ring surrounds the second tubular portion at the level of the outlet ports to form an annulus therewith, whereby ambient air is induced through the annulus to mix with the gases exhausting from the passageway.

21. An exhaust fan apparatus as defined in claim 20, wherein the second tubular member is of frusto-conical cross-section but includes a central gap defined by opposed flat wall members defining the two respective passageways.

22. An exhaust fan apparatus as defined in claim 21, wherein the diffuser is an inverted frusto-conical tube extending from the outlet discharge port of the scroll casing.

23. An exhaust fan apparatus as defined in claim 19, wherein the plane containing the axes of the passageways also contains the axis of the fan shaft.

* * * * *

UNITED STATES PATENT AND TRADEMARK OFFICE

CERTIFICATE OF CORRECTION

PATENT NO. : 6,112,850
APPLICATION NO. : 09/390796
DATED : September 5, 2000
INVENTOR(S) : Lynn Thomas Secrest and Paul Anthony Tetley It is certified that error appears in the above-identified patent and that said Letters Patent is hereby corrected as shown below:

Column 8, line 4, delete “inner” and replace with --outer--.

Signed and Sealed this

Seventh Day of November, 2006

JON W. DUDAS
*Director of the United States Patent and Trademark Office*